US009576529B2

(12) United States Patent
Xu

(10) Patent No.: US 9,576,529 B2
(45) Date of Patent: Feb. 21, 2017

(54) DRIVING CIRCUIT FOR A DISPLAY PANEL AND LIQUID CRYSTAL DISPLAY DEVICE USING THE SAME

(71) Applicant: Shenzhen China Star Optoelectronics Technology Co., Ltd., Shenzhen, Guangdong (CN)

(72) Inventor: Xiangyang Xu, Shenzhen (CN)

(73) Assignee: Shenzhen Chine Star Optoelectronics Technology Co., Ltd. (CN)

( * ) Notice: Subject to any disclaimer, the term of this patent is extended or adjusted under 35 U.S.C. 154(b) by 436 days.

(21) Appl. No.: 14/377,309

(22) PCT Filed: May 7, 2014

(86) PCT No.: PCT/CN2014/076920

§ 371 (c)(1),
(2) Date: Aug. 7, 2014

(87) PCT Pub. No.: WO2015/168871

PCT Pub. Date: Nov. 12, 2015

(65) Prior Publication Data

US 2016/0343297 A1 Nov. 24, 2016

(30) Foreign Application Priority Data

May 4, 2014 (CN) ..... 2014 1 0184912

(51) Int. Cl.

| | |
|---|---|
| ***G09G 3/3233*** | (2016.01) |
| ***G09G 3/32*** | (2016.01) |
| ***G09G 3/36*** | (2006.01) |

(52) U.S. Cl.

CPC ..... *G09G 3/3233* (2013.01); *G09G 3/32* (2013.01); *G09G 3/3258* (2013.01);
(Continued)

(58) Field of Classification Search

CPC .... G09G 3/3233; G09G 3/3241; G09G 3/325; G09G 3/3258; G09G 3/3208; G09G 3/3225; G09G 3/3291; G09G 3/30; G09G 3/32; G09G 2300/0819; G09G 2300/0842; G09G 2300/08; G09G 2300/043; G09G 2300/0465; G09G 2300/0861; G09G 2300/0852; G09G 2300/0876; G09G 2300/0847; G09G 2310/0256; G09G 2310/0262; G09G 2310/0251; G09G 2310/0243; G09G 2320/043; G09G 2320/045; G09G 2320/0233; G09G 2320/04; G09G 2300/0439

See application file for complete search history.

(56) References Cited

U.S. PATENT DOCUMENTS

2005/0140605 A1* 6/2005 Jung ..... G09G 3/3233 345/76
2005/0237281 A1* 10/2005 Tam ..... G09G 3/3233 345/76

(Continued)

*Primary Examiner* — Grant Sitta
*Assistant Examiner* — Amen Bogale
(74) *Attorney, Agent, or Firm* — Roger D. Emerson; Emerson, Thomson & Bennett, LLC

(57) ABSTRACT

A driving circuit is provided to reduce threshold voltage shifting of a driving switch thereof, and includes a capacitor, a pre-charging switch, a scanning switch, a driving switch, three stabilizing switches, and a light emitting device. A gate electrode of the pre-charging switch receives a first control signal, a drain electrode thereof receives a second control signal, and a source electrode thereof is connected to the capacitor, so as to pre-charge the capacitor to switch on the driving switch. The capacitor then discharges through the driving switch. When the driving circuit reaches a stable state, the driving switch drives the light emitting device to emit light.

16 Claims, 4 Drawing Sheets

(52) U.S. Cl.
CPC ... *G09G 3/3648* (2013.01); *G09G 2300/0426* (2013.01); *G09G 2300/0819* (2013.01); *G09G 2310/0251* (2013.01); *G09G 2320/045* (2013.01)

(56) References Cited

U.S. PATENT DOCUMENTS

| | | | | |
|---|---|---|---|---|
| 2006/0221009 | A1* | 10/2006 | Miwa | G09G 3/325 345/76 |
| 2007/0001958 | A1* | 1/2007 | Lee | G09G 3/325 345/92 |
| 2007/0128583 | A1* | 6/2007 | Miyazawa | G09G 3/3233 434/433 |
| 2007/0279337 | A1* | 12/2007 | Kim | G09G 3/3233 345/76 |
| 2008/0169754 | A1* | 7/2008 | Yang | G09G 3/3233 313/504 |
| 2010/0171685 | A1* | 7/2010 | Kimura | G09G 3/3233 345/76 |
| 2011/0141160 | A1* | 6/2011 | Nathan | G09G 3/3233 345/690 |
| 2013/0222440 | A1* | 8/2013 | Ikeda | G09G 3/3233 345/690 |
| 2014/0152191 | A1* | 6/2014 | Yang | G09G 3/3233 315/240 |
| 2014/0340432 | A1* | 11/2014 | Chaji | G09G 3/3233 345/690 |
| 2015/0084054 | A1* | 3/2015 | Fan | G02F 1/00 257/72 |

* cited by examiner

DRIVING CIRCUIT FOR A DISPLAY PANEL AND LIQUID CRYSTAL DISPLAY DEVICE USING THE SAME

This application claims priority under 35 U.S.C. §119 to International Patent Application No. PCT/CN2014/076920 filed on May 7, 2014, which in turn, claims priority to China Patent Application Serial Number 201410184912.9, filed on May 4, 2014, both of which are herein incorporated by reference in their entireties.

BACKGROUND OF THE INVENTION

Field of the Invention

The present invention relates to the field of display technology, and more particularly to a driving circuit for a display panel and a liquid crystal display device using the same.

Description of the Related Art

As a new generation display technology, Active Matrix Organic Light Emitting Diode (AMOLED) display panels have the advantages of low power consumption, a wide color gamut, high brightness, high resolution, etc., thereby being favored by the market. However, since the emission of AMOLED is driven with an electric current flowing from a transistor operated in saturation, the use of AMOLED has faced many problems including:

Organic light emitting diodes (OLED) have an aging problem. Since most of the conventional technologies use DC driving, holes and electrons are fixed in moving directions, they are respectively injected into an emission layer from an anode and cathode to form excitons through recombination, and eventually resulting in light emission. Redundant holes (or electrons) that were not involved in the recombination process may accumulate at a junction between a hole transport layer and the emission layer (or between the emission layer and an electron transport layer), or may pass through a potential energy barrier and then enter the electrodes. As the work time of the OLEDs extends, those un-recombined charge carriers which have accumulated at the junction will form a built-in electric field inside the OLEDs, and thereby result in a continuous increase in threshold voltage of each one of those light emitting diodes, thereby lowering their brightness, and also gradually reducing the energy utilization efficiency.

In a low-temperature poly-silicon (LTPS) technology, known as the mainstream manufacturing technology for OLEDs, there is a lack of uniformity in the threshold voltage of the transistors manufactured by the LTPS technology. Therefore, when the same gray-scale voltages are inputted to the transistors, different threshold voltages will generate different driving currents, and lead to inconsistency of electric current.

For example, with reference to FIG. 1, FIG. 1 shows a conventional 2T1C (two transistor, one capacitor) AMOLED driving circuit design, wherein member 11 is a thin-film transistor which is a scanning switch for controlling a capacitor 10; member 12 is an OLED driving transistor that is used to drive an OLED; the capacitor 10 is used to store the gray-scale voltage of a data signal, so as to control the driving current of transistor 12 to the OLED. In the circuit diagram, "Gate n" means the scanning signal from the n-th scanning line, "Data n" means the data signal from the n-th data line, and "$V_{dd}$" means the driving signal of the OLED. Due to the aforementioned aging problem of OLEDs and uniformity problems which occur in the LTPS manufacturing process, the threshold voltage Vth of the transistor in this conventional 2T1C driving circuit is shifted, thereby causing unstable gray-scale performance of the OLED and worse uniformity of the driven images.

SUMMARY OF THE INVENTION

An object of the present invention is to provide a driving circuit for a display panel and a liquid crystal display device using the same that prevent the threshold voltage of the thin-film transistor for driving OLEDs from being shifted, so as to enhance the stability of the gray-scale performance of the OLEDs and the uniformity of the driven images.

In order to achieve the foregoing object, the technical solutions of the present invention are as follows:

A driving circuit for a display panel includes:

a capacitor;

a pre-charging switch including a first gate electrode, a first source electrode, and a first drain electrode, wherein the first gate electrode is used to receive a first control signal sent from a first signal source; the first drain electrode is used to receive a second control signal sent from a second signal source; and the first source electrode is connected to the capacitor;

a scanning switch including a second gate electrode, a second source electrode, and a second drain electrode, wherein the second gate electrode is used to receive the second control signal, and the second source electrode is used to receive a first power signal from a first power input terminal;

a driving switch including a third gate electrode, a third source electrode, and a third drain electrode, wherein the third source electrode is connected to the second drain electrode of the scanning switch;

a first stabilizing switch including a fourth gate electrode, a fourth source electrode and a fourth drain electrode, wherein the fourth gate electrode is used to receive the second control signal; the fourth source electrode is connected to the third drain electrode; and the fourth drain electrode is connected to the third gate electrode and the capacitor;

a second stabilizing switch including a fifth gate electrode, a fifth source electrode and a fifth drain electrode, wherein the fifth gate electrode is connected to the fourth gate electrode; the fifth drain electrode is connected to the third drain electrode; and the fifth source electrode is connected to a light emitting device; and a third stabilizing switch including a sixth gate electrode, a sixth source electrode and a sixth drain electrode, wherein the sixth gate electrode is connected to the fourth gate electrode; the sixth source electrode is connected to third source electrode; and the sixth drain electrode receives the second power signal from the second power input terminal; wherein the pre-charging switch is an N-type thin-film transistor that is used to pre-charge the capacitor according to the first control signal and second control signal, so as to switch on the driving switch.

In the foregoing driving circuit for a display panel, the scanning switch, the driving switch, and the first stabilizing switch are N-type thin-film transistors; and the second stabilizing switch and the third stabilizing switch are P-type thin-film transistors.

In the foregoing driving circuit for a display panel, the driving circuit is used to control the on/off actions of the pre-charging switch, the scanning switch, the driving switch, the first stabilizing switch, the second stabilizing switch, and the third stabilizing switch through the cooperation of the first control signal and the second control signal.

In the foregoing driving circuit for a display panel, when the first control signal and the second control signal are at a high level, the pre-charging switch is switched on, and the scanning switch, the driving switch, the first stabilizing switch, the second stabilizing switch, and third stabilizing switch are switched off; wherein the electric current of the driving circuit is inputted from the second signal source, then passes through the pre-charging switch to pre-charge the capacitor, a voltage across two ends of the capacitor after pre-charging is greater than a voltage of the first power signal.

In the foregoing driving circuit for a display panel, when the first control signal is at a low level and the second control signal is at a high level, the scanning switch, the driving switch, and the first stabilizing switch are switched on, and the pre-charging switch, the second stabilizing switch, and third stabilizing switch are switched off; wherein the capacitor discharges; the electric current of the driving circuit is outputted from the capacitor, and then passes through the first stabilizing switch, the driving switch, and the scanning switch in order; and the capacitor stops discharging when a voltage across two ends of the capacitor equals a voltage of the first power signal.

In the foregoing driving circuit for a display panel, when the first control signal and the second control signal are at a low level, the driving switch, the second stabilizing switch, and third stabilizing switch are switched on, and the pre-charging switch, the scanning switch, and the first stabilizing switch are switched off; wherein the electric current of the driving circuit is inputted from the second power input terminal, then passes through the third stabilizing switch, the driving switch, the second stabilizing switch, and the light emitting device in order, so as to drive the light emitting device to emit light.

A driving circuit for a display panel includes:

a capacitor;

a pre-charging switch including a first gate electrode, a first source electrode, and a first drain electrode, wherein the first gate electrode is used to receive a first control signal sent from a first signal source; the first drain electrode is used to receive a second control signal sent from a second signal source; and the first source electrode is connected to the capacitor;

a scanning switch including a second gate electrode, a second source electrode, and a second drain electrode, wherein the second gate electrode is used to receive the second control signal; the second source electrode is used to receive a first power signal from a first power input terminal;

a driving switch including a third gate electrode, a third source electrode, and a third drain electrode, wherein the third source electrode is connected to the second drain electrode of the scanning switch;

a first stabilizing switch including a fourth gate electrode, a fourth source electrode, and a fourth drain electrode, wherein the fourth gate electrode is used to receive the second control signal; the fourth source electrode is connected to the third drain electrode; and the fourth drain electrode is connected to the third gate electrode and the capacitor;

a second stabilizing switch including a fifth gate electrode, a fifth source electrode, and a fifth drain electrode, wherein the fifth gate electrode is connected to the fourth gate electrode; the fifth drain electrode is connected to the third drain electrode; and the fifth source electrode is connected to a light emitting device; and a third stabilizing switch including a sixth gate electrode, a sixth source electrode, and a sixth drain electrode, wherein the sixth gate electrode is connected to the fourth gate electrode; the sixth source electrode is connected to the third source electrode; and the sixth drain electrode receives a second power signal from a second power input terminal.

In the foregoing driving circuit for a display panel, the pre-charging switch, the scanning switch, the driving switch, and the first stabilizing switch are N-type thin-film transistors; and the second stabilizing switch and the third stabilizing switch are P-type thin-film transistors.

In the foregoing driving circuit for a display panel, the driving circuit is used to control the on/off actions of the pre-charging switch, the scanning switch, the driving switch, the first stabilizing switch, the second stabilizing switch, and the third stabilizing switch through the cooperation of the first control signal and the second control signal.

In the foregoing driving circuit for a display panel, the pre-charging switch is used to pre-charge the capacitor according to the first control signal and second control signal, so as to switch on the driving switch.

In the foregoing driving circuit for a display panel, wherein when the first control signal and the second control signal are at a high level, the pre-charging switch is switched on, and the scanning switch, the driving switch, the first stabilizing switch, the second stabilizing switch, and third stabilizing switch are switched off; wherein the electric current of the driving circuit is inputted from the second signal source, then passes through the pre-charging switch to pre-charge the capacitor, a voltage across two ends of the capacitor after pre-charging is greater than a voltage of the first power signal.

In the foregoing driving circuit for a display panel, when the first control signal is at a low level, and the second control signal is at a high level, the scanning switch, the driving switch, and the first stabilizing switch are switched on, and the pre-charging switch, the second stabilizing switch, and third stabilizing switch are switched off; wherein the capacitor discharges; the electric current of the driving circuit is outputted from the capacitor, then passes through the first stabilizing switch, the driving switch, and the scanning switch in order; and the capacitor stops discharging when a voltage across two ends of the capacitor equals a voltage of the first power signal.

In the foregoing driving circuit for a display panel, when the first control signal and the second control signal are at a low level, the driving switch, the second stabilizing switch, and third stabilizing switch are switched on, and the pre-charging switch, the scanning switch, and the first stabilizing switch are switched off; wherein the electric current of the driving circuit is inputted from the second power input terminal, then passes through the third stabilizing switch, the driving switch, the second stabilizing switch, and the light emitting device in order, so as to drive the light emitting device to emit light.

A liquid crystal display device has a driving circuit for a display panel. The driving circuit includes:

a capacitor;

a pre-charging switch including a first gate electrode, a first source electrode, and a first drain electrode, wherein the first gate electrode is used to receive a first control signal sent from a first signal source; the first drain electrode is used to receive a second control signal sent from a second signal source; and the first source electrode is connected to the capacitor;

a scanning switch including a second gate electrode, a second source electrode and a second drain electrode, wherein the second gate electrode is used to receive the second control signal; the second source electrode is used to receive a first power signal from a first power input terminal;

a driving switch including a third gate electrode, a third source electrode, and a third drain electrode, wherein the third source electrode is connected to the second drain electrode of the scanning switch;

a first stabilizing switch including a fourth gate electrode, a fourth source electrode, and a fourth drain electrode, wherein the fourth gate electrode is used to receive the second control signal; the fourth source electrode is connected to the third drain electrode; and the fourth drain electrode is connected to the third gate electrode and the capacitor;

a second stabilizing switch including a fifth gate electrode, a fifth source electrode, and a fifth drain electrode, wherein the fifth gate electrode is connected to the fourth gate electrode; the fifth drain electrode is connected to the third drain electrode; and the fifth source electrode is connected to a light emitting device; and a third stabilizing switch including a sixth gate electrode, a sixth source electrode, and a sixth drain electrode, wherein the sixth gate electrode is connected to the fourth gate electrode; the sixth source electrode is connected to the third source electrode; and the sixth drain electrode receives a second power signal from a second power input terminal.

In the foregoing liquid crystal display device, the pre-charging switch, the scanning switch, the driving switch, and the first stabilizing switch are N-type thin-film transistors; and the second stabilizing switch and the third stabilizing switch are P-type thin-film transistors.

In the foregoing liquid crystal display device, when the first control signal and the second control signal are at a high level, the pre-charging switch is switched on, and the scanning switch, the driving switch, the first stabilizing switch, the second stabilizing switch, and third stabilizing switch are switched off; wherein the electric current of the driving circuit is inputted from the second signal source, then passes through the pre-charging switch to pre-charge the capacitor, a voltage across two ends of the capacitor after pre-charging is greater than a voltage of the first power signal;

when the first control signal is at a low level and the second control signal is at a high level, the scanning switch, the driving switch, and the first stabilizing switch are switched on, and the pre-charging switch, the second stabilizing switch, and third stabilizing switch are switched off; wherein the capacitor discharges; the electric current of the driving circuit is outputted from the capacitor, and then passes through the first stabilizing switch, the driving switch, and the scanning switch in order; and the capacitor stops discharging when the voltage across the ends of the capacitor equals the voltage of the first power signal; and when the first control signal and the second control signal are at a low level, the driving switch, the second stabilizing switch, and third stabilizing switch are switched on, and the pre-charging switch, the scanning switch, and the first stabilizing switch are switched off; wherein the electric current of the driving circuit is inputted from the second power input terminal, then passes through the third stabilizing switch, the driving switch, the second stabilizing switch, and the light emitting device in order, so as to drive the light emitting device to emit light.

Compared with the conventional technology, the circuit structure of the present invention is composed of six thin-film transistors and one capacitor, wherein the capacitor is pre-charged to turn on the driving switch and then discharges; the driving circuit then reaches a stable state, and thereafter the driving switch drives the OLEDs to emit light. With the process of pre-charging and discharging the capacitor, the driving circuit changes the direction of the electric current passing through the driving switch, thereby reducing the shifting of the threshold voltage of the driving switch, so as to enhance the stability of the gray-scale performance of the OLEDs and the uniformity of the driven images.

DETAILED DESCRIPTION OF THE PREFERRED EMBODIMENTS

The following description of each embodiment is referring to the accompanying drawings so as to illustrate practicable specific embodiments in accordance with the present invention.

Figure 1:
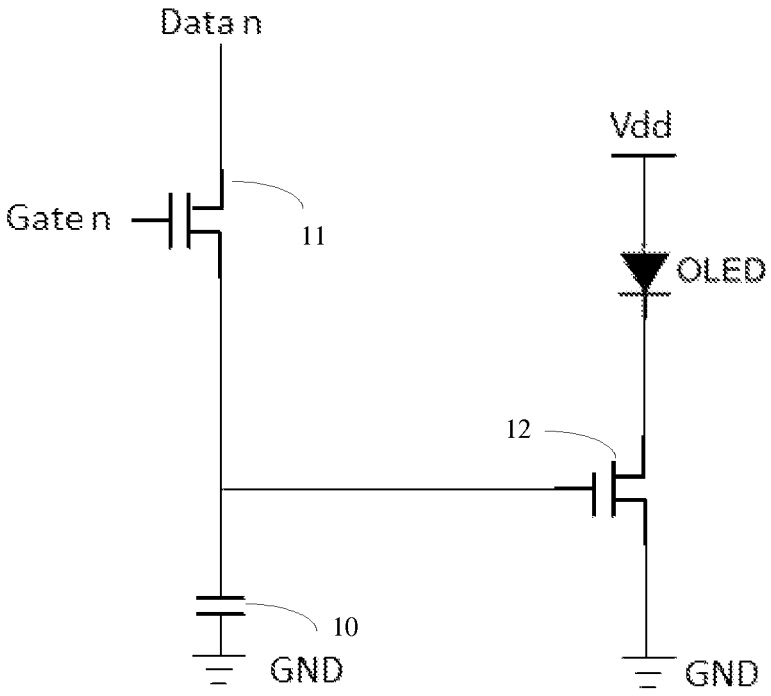
FIG. 1 PRIOR ART
FIG. 1 is a schematic diagram of a conventional driving circuit for a display panel.
Figure 2:
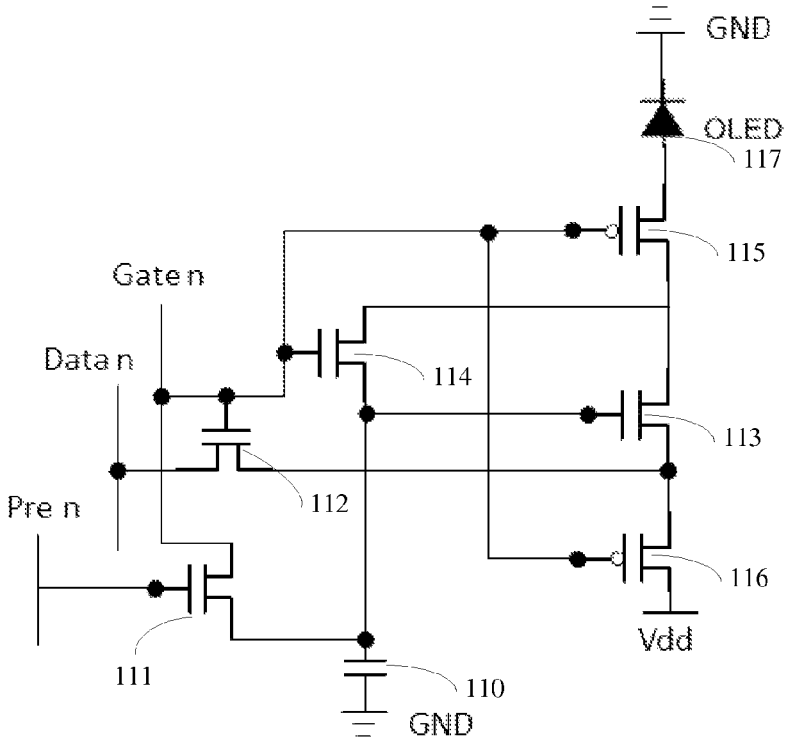
FIG. 2 is a schematic diagram of a driving circuit for a display panel according to an embodiment of the present invention.

With reference to FIG. 2, FIG. 2 is a schematic structural diagram of a driving circuit for a display panel according to an embodiment of the present invention.

The driving circuit for the display panel of the present embodiment has a capacitor 110, a pre-charging switch 111, a scanning switch 112, a driving switch 113, a first stabilizing switch 114, a second stabilizing switch 115, a third stabilizing switch 116, and a light emitting device 117.

The pre-charging switch 111 includes a first gate electrode, a first source electrode, and a first drain electrode, wherein the first gate electrode is used to receive a first control signal from a first signal source; the first drain electrode is used to receive a second control signal from a second signal source; and the first source electrode is connected to the capacitor 110.

It should be understood that the capacitor 110 includes a first electrode plate and a second electrode plate, wherein the first electrode plate of the capacitor 110 is connected to the first source electrode, and the second electrode plate is connected to ground. In this embodiment, any control switches which are connected to the capacitor 110 should be understood as being connected to the first electrode plate of the capacitor 110.

The scanning switch 112 includes a second gate electrode, a second source electrode, and a second drain electrode, wherein the second gate electrode is used to receive the second control signal, and the second source electrode is used to receive a first power signal from a first power input terminal.

The driving switch 113 includes a third gate electrode, a third source electrode, and a third drain electrode, wherein the third source electrode is connected to the second drain electrode of the scanning switch 112.

The first stabilizing switch 114 includes a fourth gate electrode, a fourth source electrode, and a fourth drain electrode. The fourth gate electrode is used to receive the second control signal. The fourth source electrode is connected to the third drain electrode. The fourth drain electrode is connected to the third gate electrode, and also connected to the capacitor 110.

The second stabilizing switch 115 includes a fifth gate electrode, a fifth source electrode, and a fifth drain electrode. The fifth gate electrode is connected to the fourth gate electrode. The fifth drain electrode is connected to the third drain electrode. The fifth source electrode is connected to the light emitting device 117.

The third stabilizing switch 116 includes a sixth gate electrode, a sixth source electrode, and a sixth drain electrode. The sixth gate electrode is connected to the fourth gate electrode. The sixth source electrode is connected to the third source electrode. The sixth drain electrode receives a second power signal from a second power input terminal.

Furthermore, in the embodiment of the present invention, the pre-charging switch 111, the scanning switch 112, the driving switch 113, and the first stabilizing switch 114 are all N-type thin-film transistors; and the second stabilizing switch 115 and the third stabilizing switch 116 are both P-type thin-film transistors. The type of each switch may be decided upon based on specific requirements, thus the example here does not limit the present invention.

In the following embodiment, the pre-charging switch 111, the scanning switch 112, the driving switch 113, and the first stabilizing switch 114 are implemented as N-type thin-film transistors, and the second stabilizing switch 115 and the third stabilizing switch 116 are implemented as P-type thin-film transistors for analyzing the circuit.

With reference to FIG. 2, the driving circuit is used to control the on/off actions of the pre-charging switch 111, the scanning switch 112, the driving switch 113, the first stabilizing switch 114, the second stabilizing switch 115, and the third stabilizing switch 116 through the cooperation of the first control signal and the second control signal. It is understood that the on/off action of each thin-film transistor corresponds to a conducting state or a non-conducting state of the electric current channel formed between the source electrode and the drain electrode of the thin-film transistor.

For convenience of description, in the driving circuit for a display panel provided by the embodiment of the present invention, the first control signal sent from the first signal source is labeled with "Pre n"; the second control signal sent from the second signal source is labeled with "Gate n"; the first power signal from the first power input terminal is labeled with "Data n"; the second power signal from the second power input terminal is labeled with "Vdd", wherein the first control signal (Pre n) may be considered as a voltage control signal for pre-charging; the second control signal (Gate n) is a scanning signal for a n-th row of pixels; the first power signal (Data n) is a data signal for an n-th column of pixels; the second power signal (Vdd) provides driving voltage to the light emitting device 117. In the driving circuit for a display panel, the light emitting device 117 may be at least one OLED.

Specifically, the following sections will describe the working principle of the driving circuit based on the driving circuit adopting a 6T1C (six transistors and one capacitor) OLED driving circuit design as shown in FIG. 2.

Figure 3:
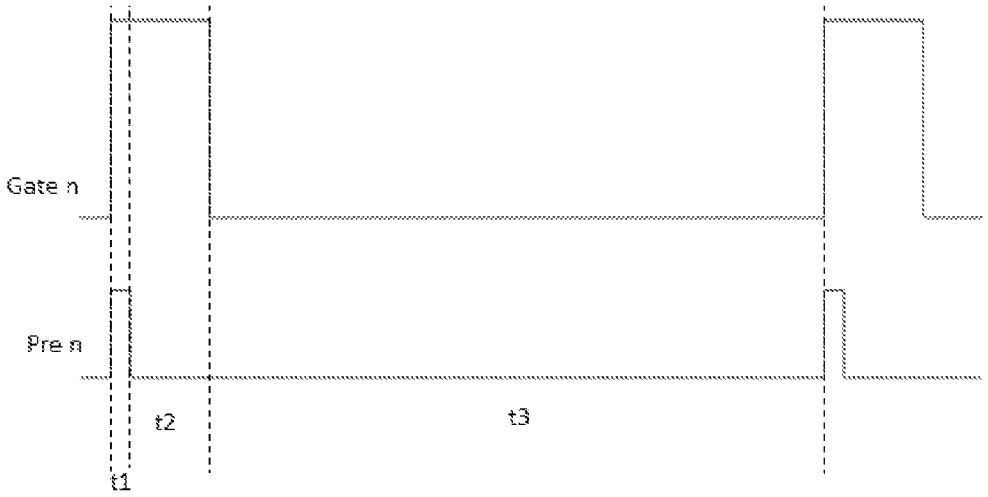
FIG. 3 is a driving timing diagram of the driving circuit for the display panel according to an embodiment of the present invention.
Figure 4:
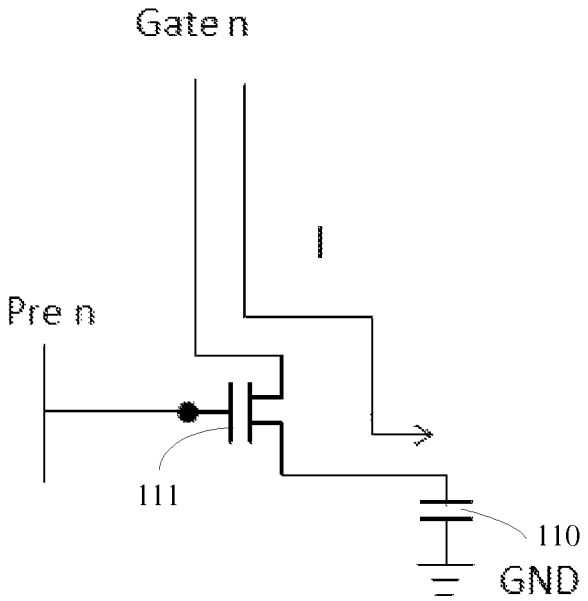
FIG. 4 is a schematic diagram of the equivalent circuit of the driving circuit for the display panel during a time period t1 according to an embodiment of the present invention.

With further reference to FIG. 3, FIG. 3 is a driving timing diagram of the driving circuit for the display panel. Firstly, during a time period t1, the first control signal (Pre n) and the second control signal (Gate n) are at a high level, and the pre-charging switch 111 is switched on; meanwhile, the scanning switch 112, the driving switch 113, the first stabilizing switch 114, the second stabilizing switch 115, and the third stabilizing switch 116 are in a switched-off state. With further reference to FIG. 4, FIG. 4 is a schematic diagram of the equivalent circuit of the driving circuit for the display panel during a time period t1, wherein during the time period t1, the electric current I of the driving circuit is inputted from the second signal source, then passes through the pre-charging switch 111 to pre-charge the capacitor 110. A voltage across two ends of the capacitor 110 after pre-charging is greater than a voltage of the first power signal (Data n).

It should be understood that, in this embodiment, the pre-charging switch 111 is a pre-charging switch for the capacitor 110, which is switched on according to the first control signal (Pre n) and the second control signal (Gate n), and then pre-charges the capacitor 110 during the time period t1 to activate the driving switch 113. That is, to provide a driving voltage to the driving switch 113. The voltage across the two ends of the capacitor 110 after pre-charging is far greater than a threshold voltage Vth of a thin-film transistor. In this embodiment, the voltage across the two ends of the capacitor 110 after pre-charging may reach 20 to 40 Volts.

It should be noted that the length of the time period t1 may be determined by the voltage which crosses the ends of the capacitor 110 after pre-charging according to according to user's requirements. For example, if the voltage across the ends of the capacitor 110 is set to be 30V after pre-charging, then the time period t1 should be the time used in charging the capacitor 110 to 30V. Thereafter, by controlling the level of the first control signal (Pre n) and the second control signal (Gate n), the driving switch 113 can be switched on during next time period t2.

Figure 5:
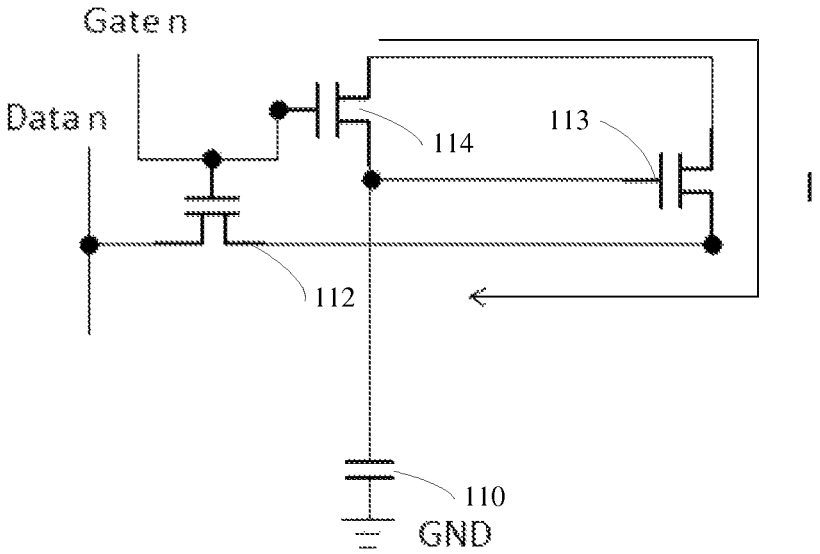
FIG. 5 is a schematic diagram of the equivalent circuit of the driving circuit for the display panel during a time period t2 according to an embodiment of the present invention.

As shown in FIG. 3, during the time period t2, the first control signal (Pre n) is at a low level, and the second control signal (Gate n) is at a high level, and the scanning switch 112, the driving switch 113, and the first stabilizing switch 114 are switched on, the pre-charging switch 111, the second stabilizing switch 115, and the third stabilizing switch 116 are in a switched-off state. With further reference to FIG. 5, FIG. 5 is a schematic diagram of the equivalent circuit of the driving circuit for the display panel during a time period t2, wherein during the time period t2, the capacitor 110 discharges, and the electric current I of the driving circuit is outputted from the capacitor 110, and then passes through the first stabilizing switch 114, the driving switch 113, and the scanning switch 112 in order; and the capacitor stops discharging when the voltage across the two ends of the capacitor 110 equals the voltage of the first power signal (Data n).

It should be understood that, in this embodiment, the scanning switch 112 is mainly the switch that controls the charging of the capacitor 110; the driving switch 113 is a driving transistor for the light emitting device 117, mainly used to drive the light emitting device 117; during the time period t2, the capacitor 110 discharges, and when the voltage across the two ends of the capacitor 110 equals the voltage of the first power signal (Data n), the capacitor 110 then stops discharging. That is, the capacitor 110 is mainly used to store a gray-scale voltage of the first power signal (Data n), then to further control the driving electric current of the driving switch 113 to the light emitting device 117.

It should be noted that, in some embodiments, it can be controlled that when the voltage across the two ends of the capacitor 110 satisfies a predetermined threshold value range, the capacitor 110 stops discharging. This predetermined threshold value range may be determined according to the gray-scale voltage of the first power signal. In addition, when the capacitor 110 finishes discharging (meaning when the voltage across the ends of the capacitor 110 equals the voltage of the first power signal (Data n)) during t2, the voltage of the second drain electrode of the scanning switch 112 equals that of the second source electrode, then the driving circuit is at a stable and balanced state.

Figure 6:
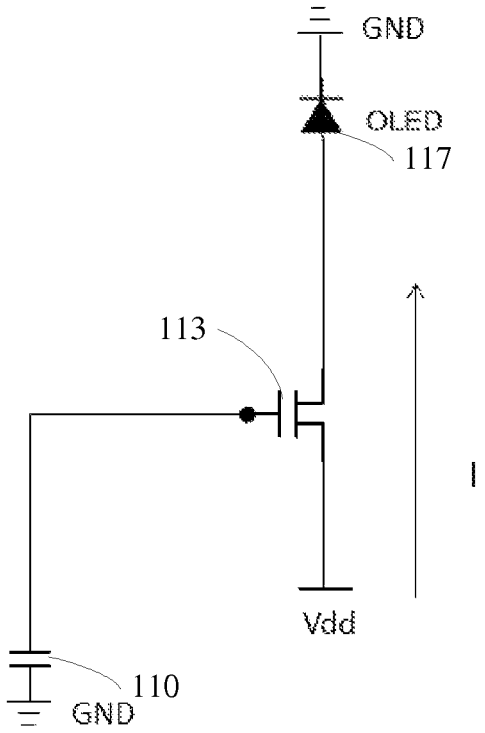
FIG. 6 is a schematic diagram of the equivalent circuit of the driving circuit for the display panel during a time period t3 according to an embodiment of the present invention.

With reference to FIG. 3, during a time period t3, the first control signal (Pre n) and the second control signal (Gate n) are both at a low level, wherein the driving switch 113, the second stabilizing switch 115, and the third stabilizing switch 116 are switched on; the pre-charging switch 111, the scanning switch 112, and the first stabilizing switch 114 are switched off. With further reference to FIG. 6, FIG. 6 is a schematic diagram of the equivalent circuit of the driving circuit for the display panel during a time period t3, the electric current I of the driving circuit is inputted from the second power input terminal, and then passes through the third stabilizing switch 116, the driving switch 113, the second stabilizing switch 115, and the light emitting device 117 in order, to drive the light emitting device 117 to emit light.

It should be understood that, in this embodiment, since the second stabilizing switch 115 and the third stabilizing switch 116 are P-type thin-film transistors, when the fifth gate electrode of the second stabilizing switch 115 and the sixth gate electrode of the third stabilizing switch 116 are inputted with a low-level signal, the second stabilizing switch 115 and the third stabilizing switch 116 are switched on, and an electric current in a drain-to-source direction is conducted; wherein when the control signal for the third gate electrode of the driving switch 113 is at a high level, the driving switch 113 is switched on, and the second power signal Vdd is a driving voltage to the light emitting device 117 for driving the light emitting device 117 to emit light.

With reference to both FIG. 5 and FIG. 6, when the capacitor 110 is discharging, the electric current I flowing through the driving switch 113 is in a direction from third drain electrode to third source electrode. When driving the light emitting device 117 to emit light, the electric current I flowing through the driving switch 113 is in a direction from the third source electrode to the third drain electrode. That is, during the process of pre-charging the capacitor 110 and the process of the discharging of the capacitor 110, the driving electric current of the driving switch 113 flows in opposite directions, respectively, thereby achieving an object of reducing the shifting of threshold voltage of the driving switch 113.

Based on the above description, in the driving circuit for a display panel of the present invention, the scanning switch 112 is a control switch for controlling the discharging of the capacitor 110; in addition to driving the light emitting device 117, such as an OLED, the driving switch 113 also allows the capacitor 110 to discharge; the first stabilizing switch 114, the second stabilizing switch 115, and third stabilizing switch 116 are control switches for stabilizing the driving switch 113; the pre-charging switch 111 is implemented mainly for pre-charging the capacitor 110 to provide an activating voltage for the scanning switch 112. By adopting the 6T1C OLED driving design and utilizing the operation of the pre-charging and discharging of the capacitor 110, the current direction flow through the driving switch 113 is changed accordingly, thereby reducing the shifting of the threshold voltage of the driving switch 113 to prevent the threshold voltage shifting of transistors from affecting the driving of the OLEDs, thus enhancing the stability of the gray-scale performance of the OLEDs and the uniformity of driven images.

In order to more specifically implement the driving circuit for a display panel provided by the embodiments of the present invention, one embodiment of the present invention further provides a device including the foregoing driving circuit for a display panel, wherein the terms used for describing this device are the same as the terms described in the above-mentioned driving circuit for a display circuit, thus specific implementation details may refer to the description of the embodiments of the driving circuit.

Figure 7:
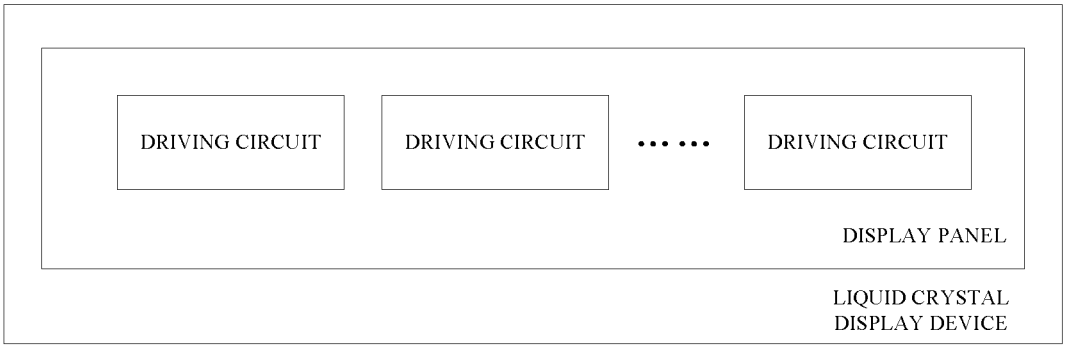
FIG. 7 is a schematic structural diagram of a liquid crystal display device according to an embodiment of the present invention.

With reference to FIG. 7, FIG. 7 is a schematic structural diagram of a liquid crystal display device provided by the present invention, wherein the liquid crystal display device includes a driving circuit for a display panel as shown in FIG. 2. The driving circuit includes: a capacitor 110, a pre-charging switch 111, a scanning switch 112, a driving switch 113, a first stabilizing switch 114, a second stabilizing switch 115, a third stabilizing switch 116, and a light emitting device 117.

The pre-charging switch 111 includes a first gate electrode, a first source electrode, and a first drain electrode, wherein the first gate electrode is used to receive a first control signal from a first signal source; the first drain electrode is used to receive a second control signal from a second signal source; and the first source electrode is connected to the capacitor 110.

The scanning switch 112 includes a second gate electrode, a second source electrode, and a second drain electrode, wherein the second gate electrode is used to receive the second control signal, and the second source electrode is used to receive a first power signal from a first power input terminal.

The driving switch 113 includes a third gate electrode, a third source electrode, and a third drain electrode, wherein the third source electrode is connected to the second drain electrode of the scanning switch 112.

The first stabilizing switch 114 includes a fourth gate electrode, a fourth source electrode, and a fourth drain electrode. The fourth gate electrode is used to receive the second control signal. The fourth source electrode is connected to the third drain electrode. The fourth drain electrode is connected to the third gate electrode, and also connected to the capacitor 110.

The second stabilizing switch 115 includes a fifth gate electrode, a fifth source electrode, and a fifth drain electrode. The fifth gate electrode is connected to the fourth gate electrode. The fifth drain electrode is connected to the third drain electrode. The fifth source electrode is connected to the light emitting device 117.

The third stabilizing switch 116 includes a sixth gate electrode, a sixth source electrode, and a sixth drain electrode. The sixth gate electrode is connected to the fourth gate electrode. The sixth source electrode is connected to the third source electrode. The sixth drain electrode receives a second power signal from a second power input terminal.

Furthermore, in the embodiment of the present invention, the pre-charging switch 111, the scanning switch 112, the driving switch 113, and the first stabilizing switch 114 are all N-type thin-film transistors; and the second stabilizing switch 115 and the third stabilizing switch 116 are both P-type thin-film transistors. The type of each switch may be decided based on specific requirements, thus the example here does not limit the present invention.

With reference to FIGS. 3 to 6, during the time period t1, the first control signal (Pre n) and the second control signal (Gate n) are at a high level, and the pre-charging switch 111 is switched on; meanwhile, the scanning switch 112, the driving switch 113, the first stabilizing switch 114, the second stabilizing switch 115, and the third stabilizing switch 116 are in a switched-off state, wherein the electric current I of the driving circuit is inputted from the second signal source, then passes through the pre-charging switch 111 to pre-charge the capacitor 110. A voltage across two ends of the capacitor 110 after pre-charging is greater than a voltage of the first power signal (Data n).

During the time period t2, the first control signal (Pre n) is at a low level, and the second control signal (Gate n) is at a high level, wherein the scanning switch 112, the driving switch 113, and the first stabilizing switch 114 are switched on; the pre-charging switch 111, the second stabilizing switch 115, and the third stabilizing switch 116 are in a switched-off state, wherein the capacitor 110 discharges; the electric current I of the driving circuit then is outputted from the capacitor 110, and then passes through the first stabilizing switch 114, the driving switch 113, and the scanning switch 112 in order; it is not until the voltage across the two ends of the capacitor 110 equals the voltage of the first power signal (Data n) that the capacitor stops discharging.

During a time period t3, the first control signal (Pre n) and the second control signal (Gate n) are both at a low level, wherein the driving switch 113, the second stabilizing switch 115, and the third stabilizing switch 116 are switched on; the pre-charging switch 111, the scanning switch 112, and the first stabilizing switch 114 are switched off, wherein the electric current I of the driving circuit is inputted from the second power input terminal, and then passes through the third stabilizing switch 116, the driving switch 113, the second stabilizing switch 115, and the light emitting device 117 in order, to drive the light emitting device 117 to emit light.

The driving circuit of the liquid crystal display device provided by the present invention adopts a circuit structure with six thin-film transistors and one capacitor (6T1C) where the capacitor is pre-charged to activate the driving switch 113, then discharges, and when the driving circuit reaches a stable state, the driving switch drives OLEDs to emit light. Through the process of pre-charging and discharging the capacitor, the driving circuit changes the direction of the electric current flowing through the driving switch, thereby reducing the shifting of the threshold voltage of the driving switch, and thus enhancing the stability of gray-scale performance of the OLEDs and the uniformity of driven images.

Among the above-mentioned embodiments, each embodiment emphasizes certain aspects, thus any parts not explained in detail in some embodiments may refer to the foregoing detailed description of the driving circuit for a display panel so as to avoid redundancy.

The present invention has been described with preferred embodiments thereof, and it is understood that many changes and modifications to the described embodiment can be carried out without departing from the scope and the spirit of the invention that is intended to be limited only by the appended claims.

What is claimed is:

1. A driving circuit for a display panel comprising:

a capacitor;

a pre-charging switch including a first gate electrode, a first source electrode, and a first drain electrode, wherein the first gate electrode is used to receive a first control signal sent from a first signal source; the first drain electrode is used to receive a second control signal sent from a second signal source; and the first source electrode is connected to the capacitor;

a scanning switch including a second gate electrode, a second source electrode, and a second drain electrode, wherein the second gate electrode is used to receive the second control signal, and the second source electrode is used to receive a first power signal from a first power input terminal;

a driving switch including a third gate electrode, a third source electrode, and a third drain electrode, wherein the third source electrode is connected to the second drain electrode of the scanning switch;

a first stabilizing switch including a fourth gate electrode, a fourth source electrode, and a fourth drain electrode, wherein the fourth gate electrode is used to receive the second control signal; the fourth source electrode is connected to the third drain electrode; and the fourth drain electrode is connected to the third gate electrode and the capacitor;

a second stabilizing switch including a fifth gate electrode, a fifth source electrode, and a fifth drain electrode, wherein the fifth gate electrode is connected to the fourth gate electrode; the fifth drain electrode is connected to the third drain electrode; and the fifth source electrode is connected to a light emitting device; and a third stabilizing switch including a sixth gate electrode, a sixth source electrode, and a sixth drain electrode, wherein the sixth gate electrode is connected to the fourth gate electrode; the sixth source electrode is connected to third source electrode; and the sixth drain electrode receives the second power signal from the second power input terminal; wherein the pre-charging switch is an N-type thin-film transistor that is used to pre-charge the capacitor according to the first control signal and second control signal, so as to switch on the driving switch.

2. The driving circuit for a display panel as claimed in claim 1, wherein the scanning switch, the driving switch, and the first stabilizing switch are N-type thin-film transistors; and the second stabilizing switch and the third stabilizing switch are P-type thin-film transistors.

3. The driving circuit for a display panel as claimed in claim 2, wherein the driving circuit is used to control the on/off actions of the pre-charging switch, the scanning switch, the driving switch, the first stabilizing switch, the second stabilizing switch, and the third stabilizing switch through the cooperation of the first control signal and the second control signal.

4. The driving circuit for a display panel as claimed in claim 3, wherein when the first control signal and the second control signal are at a high level, the pre-charging switch is switched on, and the scanning switch, the driving switch, the first stabilizing switch, the second stabilizing switch, and third stabilizing switch are switched off; wherein the electric current of the driving circuit is inputted from the second signal source, then passes through the pre-charging switch to pre-charge the capacitor, wherein a voltage across two ends of the capacitor after pre-charging is greater than a voltage of the first power signal.

5. The driving circuit for a display panel as claimed in claim 3, wherein when the first control signal is at a low level and the second control signal is at a high level, the scanning switch, the driving switch, and the first stabilizing switch are switched on, and the pre-charging switch, the second stabilizing switch, and third stabilizing switch are switched off; wherein the capacitor discharges; the electric current of the driving circuit is outputted from the capacitor, and then orderly passes through the first stabilizing switch, the driving switch, and the scanning switch; and the capacitor stops discharging when a voltage across two ends of the capacitor equals a voltage of the first power signal.

6. The driving circuit for a display panel as claimed in claim 3, wherein when the first control signal and the second control signal are at a low level, the driving switch, the second stabilizing switch, and third stabilizing switch are switched on, and the pre-charging switch, the scanning switch, and the first stabilizing switch are switched off; wherein the electric current of the driving circuit is inputted from the second power input terminal, then orderly passes through the third stabilizing switch, the driving switch, the second stabilizing switch, and the light emitting device, so as to drive the light emitting device to emit light.

7. A driving circuit for a display panel comprising:

a capacitor;

a pre-charging switch including a first gate electrode, a first source electrode, and a first drain electrode, wherein the first gate electrode is used to receive a first control signal sent from a first signal source; the first drain electrode is used to receive a second control signal sent from a second signal source; and the first source electrode is connected to the capacitor;

a scanning switch including a second gate electrode, a second source electrode, and a second drain electrode, wherein the second gate electrode is used to receive the second control signal; the second source electrode is used to receive a first power signal from a first power input terminal;

a driving switch including a third gate electrode, a third source electrode, and a third drain electrode, wherein the third source electrode is connected to the second drain electrode of the scanning switch;

a first stabilizing switch including a fourth gate electrode, a fourth source electrode, and a fourth drain electrode, wherein the fourth gate electrode is used to receive the second control signal; the fourth source electrode is connected to the third drain electrode; and the fourth drain electrode is connected to the third gate electrode and the capacitor;

a second stabilizing switch including a fifth gate electrode, a fifth source electrode, and a fifth drain electrode, wherein the fifth gate electrode is connected to the fourth gate electrode; the fifth drain electrode is connected to the third drain electrode; and the fifth source electrode is connected to a light emitting device; and a third stabilizing switch including a sixth gate electrode, a sixth source electrode, and a sixth drain electrode, wherein the sixth gate electrode is connected to the fourth gate electrode; the sixth source electrode is connected to the third source electrode; and the sixth drain electrode receives a second power signal from a second power input terminal.

8. The driving circuit for a display panel as claimed in claim 7, wherein the pre-charging switch, the scanning switch, the driving switch, and the first stabilizing switch are N-type thin-film transistors; and the second stabilizing switch and the third stabilizing switch are P-type thin-film transistors.

9. The driving circuit for a display panel as claimed in claim 8, wherein the driving circuit is used to control the on/off actions of the pre-charging switch, the scanning switch, the driving switch, the first stabilizing switch, the second stabilizing switch, and the third stabilizing switch through the cooperation of the first control signal and the second control signal.

10. The driving circuit for a display panel as claimed in claim 9, wherein the pre-charging switch is used to pre-charge the capacitor according to the first control signal and second control signal, so as to switch on the driving switch.

11. The driving circuit for a display panel as claimed in claim 10, wherein when the first control signal and the second control signal are at a high level, the pre-charging switch is switched on, and the scanning switch, the driving switch, the first stabilizing switch, the second stabilizing switch, and third stabilizing switch are switched off; wherein the electric current of the driving circuit is inputted from the second signal source, then passes through the pre-charging switch to pre-charge the capacitor, a voltage across two ends of the capacitor after pre-charging is greater than a voltage of the first power signal.

12. The driving circuit for a display panel as claimed in claim 9, wherein when the first control signal is at a low level, and the second control signal is at a high level, the scanning switch, the driving switch, and the first stabilizing switch are switched on, and the pre-charging switch, the second stabilizing switch, and third stabilizing switch are switched off; wherein the capacitor discharges; the electric current of the driving circuit is outputted from the capacitor, and then orderly passes through the first stabilizing switch, the driving switch, and the scanning switch; and the capacitor stops discharging when a voltage across two ends of the capacitor equals a voltage of the first power signal.

13. The driving circuit for a display panel as claimed in claim 9, wherein when the first control signal and the second control signal are at a low level, the driving switch, the second stabilizing switch, and third stabilizing switch are switched on, and the pre-charging switch, the scanning switch, and the first stabilizing switch are switched off; wherein the electric current of the driving circuit is inputted from the second power input terminal, then passes through the third stabilizing switch, the driving switch, the second stabilizing switch, and the light emitting device in order, so as to drive the light emitting device to emit light.

14. A liquid crystal display device comprising a driving circuit for a display panel, wherein the driving circuit includes:

a capacitor;

a pre-charging switch including a first gate electrode, a first source electrode, and a first drain electrode, wherein the first gate electrode is used to receive a first control signal sent from a first signal source; the first drain electrode is used to receive a second control signal sent from a second signal source; and the first source electrode is connected to the capacitor;

a scanning switch including a second gate electrode, a second source electrode, and a second drain electrode, wherein the second gate electrode is used to receive the second control signal; the second source electrode is used to receive a first power signal from a first power input terminal;

a driving switch including a third gate electrode, a third source electrode, and a third drain electrode, wherein the third source electrode is connected to the second drain electrode of the scanning switch;

a first stabilizing switch including a fourth gate electrode, a fourth source electrode, and a fourth drain electrode, wherein the fourth gate electrode is used to receive the second control signal; the fourth source electrode is connected to the third drain electrode; and the fourth drain electrode is connected to the third gate electrode and the capacitor;

a second stabilizing switch including a fifth gate electrode, a fifth source electrode, and a fifth drain electrode, wherein the fifth gate electrode is connected to the fourth gate electrode; the fifth drain electrode is connected to the third drain electrode; and the fifth source electrode is connected to a light emitting device; and a third stabilizing switch including a sixth gate electrode, a sixth source electrode, and a sixth drain electrode, wherein the sixth gate electrode is connected to the fourth gate electrode; the sixth source electrode is connected to the third source electrode; and the sixth drain electrode receives a second power signal from a second power input terminal.

15. The liquid crystal display device as claimed in claim 14, wherein the pre-charging switch, the scanning switch, the driving switch, and the first stabilizing switch are N-type thin-film transistors; and the second stabilizing switch and the third stabilizing switch are P-type thin-film transistors.

16. The liquid crystal display device as claimed in claim 14, wherein when the first control signal and the second control signal are at a high level, the pre-charging switch is switched on, and the scanning switch, the driving switch, the first stabilizing switch, the second stabilizing switch, and third stabilizing switch are switched off; wherein the electric current of the driving circuit is inputted from the second signal source, then passes through the pre-charging switch to pre-charge the capacitor, a voltage across two ends of the capacitor after pre-charging is greater than a voltage of the first power signal;

when the first control signal is at a low level and the second control signal is at a high level, the scanning switch, the driving switch, and the first stabilizing switch are switched on, and the pre-charging switch, the second stabilizing switch, and third stabilizing switch are switched off; wherein the capacitor discharges; the electric current of the driving circuit is outputted from the capacitor, then passes through the first stabilizing switch, the driving switch, and the scanning switch in order; and the capacitor stops discharging when the voltage across the ends of the capacitor equals the voltage of the first power signal; and when the first control signal and the second control signal are at a low level, the driving switch, the second stabilizing switch, and third stabilizing switch are switched on, and the pre-charging switch, the scanning switch, and the first stabilizing switch are switched off; wherein the electric current of the driving circuit is inputted from the second power input terminal, then passes through the third stabilizing switch, the driving switch, the second stabilizing switch, and the light emitting device in order, so as to drive the light emitting device to emit light.

* * * * *